US005934825A

United States Patent [19]

Waldenberger

[11] Patent Number: 5,934,825

[45] Date of Patent: Aug. 10, 1999

[54] VIBRATORY PLATE MACHINE

[75] Inventor: David J. Waldenberger, Menomonee Falls, Wis.

[73] Assignee: Wacker Corporation, Menomonee Falls, Wis.

[21] Appl. No.: 08/841,936

[22] Filed: Apr. 8, 1997

Related U.S. Application Data

[63] Continuation-in-part of application No. 29/065,533, Jan. 28, 1997, Pat. No. Des. 393,864, and a continuation-in-part of application No. 08/789,757, Jan. 28, 1997, Pat. No. 5,890,834.

[51] Int. Cl.[6] ..... E01C 19/30

[52] U.S. Cl. ..... 404/133.1

[58] Field of Search ..... 404/102, 114, 404/117, 133.05, 133.1, 133.2

[56] References Cited

U.S. PATENT DOCUMENTS

| | | | |
|---|---|---|---|
| 3,277,801 | 10/1966 | Horvath et al. | 404/133.1 |
| 3,292,512 | 12/1966 | Schaperclaus | 404/133.2 X |
| 3,314,341 | 4/1967 | Schulin et al. | 404/133.1 X |
| 3,416,418 | 12/1968 | Frohnauer, Jr. | 404/133.1 |
| 3,486,568 | 12/1969 | Westerlund et al. | 404/102 X |
| 3,635,133 | 1/1972 | Stougaard | 404/133.2 |
| 3,703,127 | 11/1972 | Kaltenegger | 404/133.1 X |
| 3,782,845 | 1/1974 | Briggs et al. | 404/133.1 |
| 3,817,646 | 6/1974 | Opderbeck | 404/133.1 |
| 4,643,611 | 2/1987 | Pilachowski | 404/133 |
| 4,895,478 | 1/1990 | Artzberger | 404/133.1 |
| 4,966,499 | 10/1990 | St Louis | 404/133.2 X |
| 5,439,314 | 8/1995 | Wadensten | 404/133.05 |

FOREIGN PATENT DOCUMENTS

| | | | |
|---|---|---|---|
| 898 265 | 3/1984 | Belgium . | |
| 42 112 84 | 9/1993 | Germany . | |
| 1185946 | 3/1970 | United Kingdom | 404/133 |
| 2 289 409 | 11/1995 | United Kingdom . | |
| 94/20693 | 9/1994 | WIPO . | |

OTHER PUBLICATIONS

*Patent Abstracts of Japan*, vol. 18, No. 544, Oct. 18, 1994 (JP 06 193011; Jul. 12, 1994).

Wacker Corporation brochure: *Asphalt Vibratory Plates*, Mar., 1996.

Wacker Corporation brochure: *Vibratory Plates*, Jan. 1995.

Stone Construction Equipment, Inc. brochure: *Vibratory Plate*, 1993.

BOMAG brochure: *Vibratory Plates 10/36 • BP 15/45*, Oct. 1991.

M–B–W—Ground Pounder Division brochure: *Ground Pounder* (date unknown).

*Primary Examiner*—James A. Lisehora

*Attorney, Agent, or Firm*—Nilles & Nilles

[57] ABSTRACT

A vibratory plate machine has an improved baseplate, console, clutch, and/or cage assembly. The baseplate has a semi-spherical bottom surface and barrel-shaped side surfaces to improve stability and maneuverability. The baseplate also has ribs on its upper surface configured to maximize stiffening ability and to channel debris off from the baseplate. The console is formed from a single cast metal element to reduce weight and to reduce assembly complexity and to permit shockmounts to be connected to the extreme corner portions of the console. The clutch is configured to distribute as much weight as practical to its outer diameter so that it functions as a flywheel to reduce jerking effects on the driven belt to reduce belt wear and increase belt life. The cage assembly is configured to maximize protection of sensitive components of the machine from external shocks and to facilitate machine lifting.

14 Claims, 8 Drawing Sheets

VIBRATORY PLATE MACHINE

CROSS REFERENCE TO RELATED APPLICATIONS

This application is a Continuation-in-Part of U.S. Design patent application Ser. No. 29/065,533, filed Jan. 28, 1997 in the name of David J. Waldenberger and Scott H. Micoley and entitled "VIBRATORY ASPHALT PLATE", and U.S. Design Pat. No. D393,864 and a Continuation-in-Part of U.S. patent application Ser. No. 08/789,757, filed Jan. 28, 1997, now U.S. Pat. No. 5,890,834, in the name of David J. Waldenberger and entitled WATER SUPPLY SYSTEM FOR A VIBRATORY PLATE MACHINE.

BACKGROUND OF THE INVENTION

1. Field of the Invention

The invention relates to compacting machines and, more particularly, relates to improvements in a vibratory plate machine of the type used to smooth and/or compact sand, gravel, crushed aggregate, and hot and cold asphalt.

2. Discussion of the Related Art

Vibratory plate machines, usually known simply as "vibratory plates" are widely used in the construction and landscaping industries for the compaction of granular materials. Applications include the compaction of sand, gravel, or crushed aggregate for foundations, footings, or driveways; base preparation for concrete slabs, asphalt parking lots, etc.; and the compaction of either hot or cold mix asphalt during patch or repair of streets, highways, sidewalks, parking lots, etc. The typical vibratory plate machine includes a baseplate that performs the actual compacting operation and a console that is mounted on the baseplate so as to support an engine and its associated equipment. An eccentric shaft device, commonly known as an exciter, is located on the baseplate in an underlying relationship to the console and is driven by the engine to impart vibrations to the baseplate, thereby compacting materials on which the machine rests. Movement of the machine is controlled by a handle assembly extending upwardly and rearwardly from the console. In hot mix asphalt compaction applications, the machine is additionally provided with a water tank and associated equipment for spraying water on the surface immediately in front of the machine to prevent the asphalt from congealing on the baseplate.

The typical vibratory plate machine on the market today exhibits several drawbacks and disadvantages.

First, the typical vibratory plate machine is somewhat difficult to control and maneuver due in part to the profile of its bottom or compaction surface. The "profile" drawback resides in the fact that the baseplates of most traditional vibratory plate machines have a flat or planar bottom surface so that the entire bottom surface of the baseplate rests upon the surface being compacted with equal force. The resulting uniform distribution of friction significantly hinders maneuverability both fore and aft and side to side. Moreover, any rocking motion of the machine tends to ridge or otherwise mar the surface being compacted. Ridging or marring is particularly undesirable in asphalt compaction operations because, once the asphalt hardens, the paved surface is permanently marred.

At least one company attempted to alleviate these problems by imparting a slight angle or V-shape to the bottom surface of the baseplate. The vertex of the V is centered on the baseplate and runs longitudinally along the entire length of the baseplate. This design, which was developed by the assignee of this application, proved only partially effective in solving either the maneuverability problem or the ridging problem.

Maneuverability of the typical baseplate is also hindered by the general shape of it. Specifically, when viewed in bottom plan, the typical baseplate is perfectly rectangular. Some more sophisticated baseplates curl upwardly at their front and rear ends, but they still have a constant width. Accordingly, they are difficult to maneuver around corners and other obstructions.

Another problem associated with typical baseplates results from the configuration of the reinforcing ribs. Reinforcing ribs are sometimes provided on the upper surface of the baseplate to increase strength and durability. However, these ribs were heretofore configured without giving consideration to debris removal. Debris tends to fall onto the baseplate from adjoining sections of the surface during the compaction operation and to accumulate as the compaction operation continues. Reinforcement ribs and other structures on traditional baseplates tend to trap this debris on top of the baseplate, adding to the machine's weight, endangering contamination of otherwise-clean surfaces when the machine is tilted on its side or otherwise moved during operations following the compaction operation, and hindering cleaning of the machine.

Second, the console of the traditional vibratory plate machines also exhibits several disadvantages because it is formed from weldments. For instance, it is labor intensive to assemble. Many different component plates (typically 25 or more) must be machined and welded together to form the console. Moreover, the relatively heavy welded steel console undesirably increases the overall weight of the machine, thereby decreasing stability and maneuverability. The welded connections between the vertical edge plates of the console and the main horizontal plate also prevent connection of shockmounts to the extreme corner portions of the console. Elastomeric shockmounts are used to mount the console on the baseplate to reduce the imposition of vibrations on the console from the baseplate. Stability and vibration reduction measures are most effective when imposed at the extreme corners of the machine. (This principle is illustrated by recent "cab-forward" trends in automotive design which seek to improve stability by supporting the automobile chassis as near as possible to its extreme corners). Hence, by requiring that shockmounts be moved towards the center of the machine, the traditional welded console significantly frustrates attempts to increase stability and reduce vibrations.

Third, most vibratory plate machines exhibit a persistent problem of excessive belt wear because the driven pulley on the exciter and the drive pulley on the clutch are mounted on separate components of the machine (namely, the baseplate and the console, respectively) that can move relative to one another during operation of the machine. This relative movement exerts substantial jerking on the belt, leading to its rapid wear and early failure.

Fourth, most vibratory plate machines incorporate insufficient measures to 1) protect the engine and other sensitive external components in the machine from damage from external shocks and 2) facilitate lifting of the machine for site-to-site transport.

The need has therefore arisen to provide an improved vibratory plate machine lacking some or all the disadvantages described above.

OBJECTS AND SUMMARY OF THE INVENTION

It is therefore a first object of the invention to provide a vibratory plate machine having a baseplate designed to enhance the overall stability and maneuverability of the machine and to produce a smooth compacted surface without marring or ridging the surface.

In accordance with a first aspect of the invention, this object is achieved by providing a vibratory plate machine comprising a baseplate and an exciter. The baseplate has a lower surface for compacting materials, an upper surface, and opposed side surfaces connecting the upper and lower surfaces to one another. The exciter is located above the baseplate and imparts a vibratory motion to the baseplate. The lower surface of the baseplate has a convex portion which surrounds a substantial portion of the lower surface and which rests on the surface to be smoothed and/or compacted. The convex portion enhances stability and maneuverability while reducing the possibility of ridging or otherwise marring the surface being compacted.

Preferably, the lower surface of the baseplate has a planar portion which is centered under the exciter and which is at least partially surrounded by the convex portion. The convex portion has a constant curvature so as to be partially-spherical in shape, and the planar portion is semi-circular in shape.

In order to facilitate maneuvering around obstructions, the side surfaces of the baseplate are barrel-shaped so that 1) the side surfaces curve laterally outwardly and upwardly from the lower surface and 2) the lower surface is wider at a central portion thereof than at opposed longitudinal ends thereof.

Another object of the invention is to provide a vibratory plate machine having a baseplate with reinforcing ribs which reinforce the baseplate while channeling debris off from the baseplate rather than retaining it thereon.

In accordance with another aspect of the invention, this object is achieved by configuring at least some of the ribs to be generally triangular when viewed in longitudinal cross-section. Preferably, the ribs include a first rib extending laterally across a substantial length of a longitudinally central portion of the baseplate, a second rib extending longitudinally rearwardly from a laterally and longitudinally central portion of the baseplate, and third and fourth ribs located laterally between the second rib and the first and second side surfaces of the baseplate, respectively. Each of the third and fourth ribs have a front end located on the longitudinally central portion of the baseplate and a rear end located laterally beyond the front end.

Still another object of the invention is to provide a vibratory plate machine having a console that is relatively lightweight, that is easy to fabricate and assemble, and that facilitates optimal shockmount positioning.

In accordance with still another aspect of the invention, this object is achieved by providing a vibratory plate machine comprising a baseplate, an exciter, and a specially-configured console. The baseplate has a lower surface for compacting materials, an upper surface, and opposed side surfaces connecting the upper and lower surfaces to one another. The exciter is located above the baseplate and imparts a vibratory motion to the baseplate. The console is mounted on the upper surface of the baseplate and overlies the exciter. The console is formed from a unitary cast metal element. Use of the unitary cast metal console permits shockmounts to be attached to the console at a location closely adjacent a corner of the console. It also permits an oil drain trough to be cast into an upper surface of the console so as to have a first end located beneath an oil drain port of the engine, a second end terminating at an edge surface of the console, and a floor located beneath the remainder of the upper surface.

Yet another object of the invention is to provide a vibratory plate machine having a clutch configured to reduce drive belt wear.

In accordance with yet another aspect of the invention, this object is achieved by providing a centrifugal clutch comprising a shoe assembly fixed to a rotary output shaft, and a drum and pulley assembly rotatably mounted on the shaft adjacent the shoe assembly. The drum and pulley assembly include 1) a first pulley section and 2) a second pulley section and a drum integrated into a single cast metal pulley/drum assembly. The pulley/drum assembly is connected to the first pulley section.

Shims may be located between the first pulley section and the pulley/drum assembly, the number of shims being selected to accommodate variations in belt length.

Still another object of the invention is to provide a vibratory plate machine with an improved cage assembly that 1) protects sensitive components of the machine such as the engine and water tank from damage from externally imposed shocks, and/or 2) facilitates machine lifting.

In accordance with still another aspect of the invention, this object is achieved by providing a cage assembly which is mounted on the console and which extends over the engine of the machine. The cage assembly includes first and second opposed side braces each of which is bent into a generally n-shaped profile, a rear lower cross bar which is located behind the engine and which connects the first and second side braces to one another, and front and rear upper cross bars each of which is located above the engine and which connects the first and second side braces to one another.

Other objects, features, and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to the invention, a vibratory plate machine is provided having an improved baseplate, console, clutch, and/or cage assembly. The baseplate has a semi-spherical bottom surface and barrel-shaped side surfaces to improve stability and maneuverability. The baseplate also has ribs on its upper surface configured to maximize stiffening ability and to channel debris off from the baseplate. The console is formed from a single cast metal element to reduce weight and to reduce assembly complexity and to permit shock-mounts to be connected to the extreme corner portions of the console. The clutch is configured to distribute as much weight as practical to its outer diameter so that it functions as a flywheel to reduce jerking effects on the driven belt to reduce belt wear and increase belt life. The cage assembly is configured to maximize protection of sensitive components of the machine such as the water tank and to facilitate machine lifting.

2. System Overview

Figure 5:
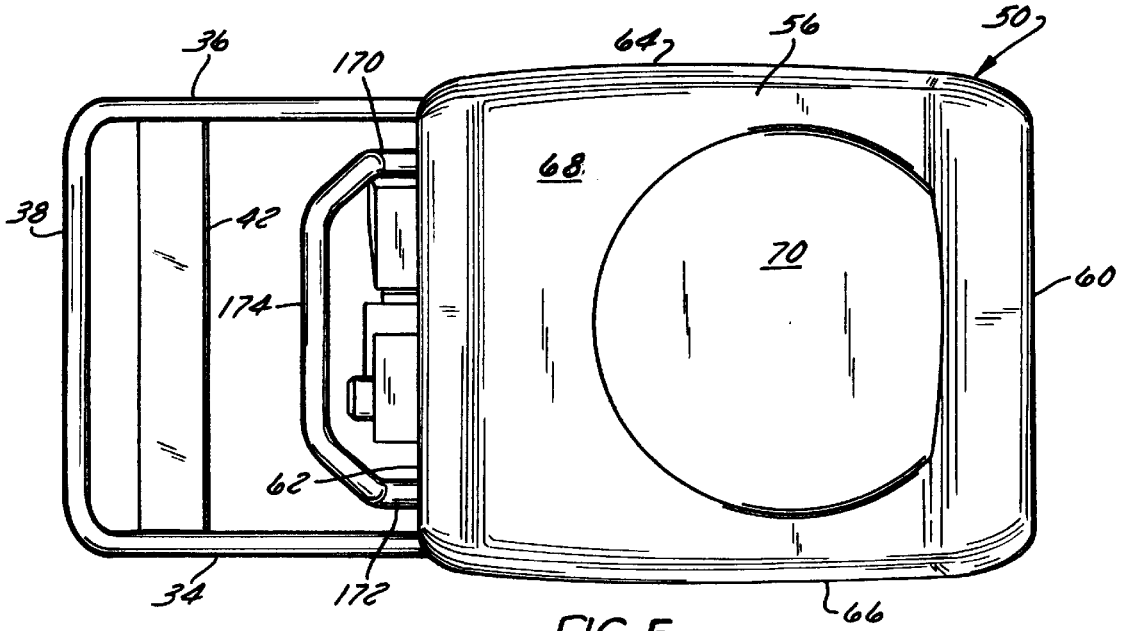
FIG. 5 is a bottom plan view of the vibratory plate machine of FIG. 1.
Figure 6:
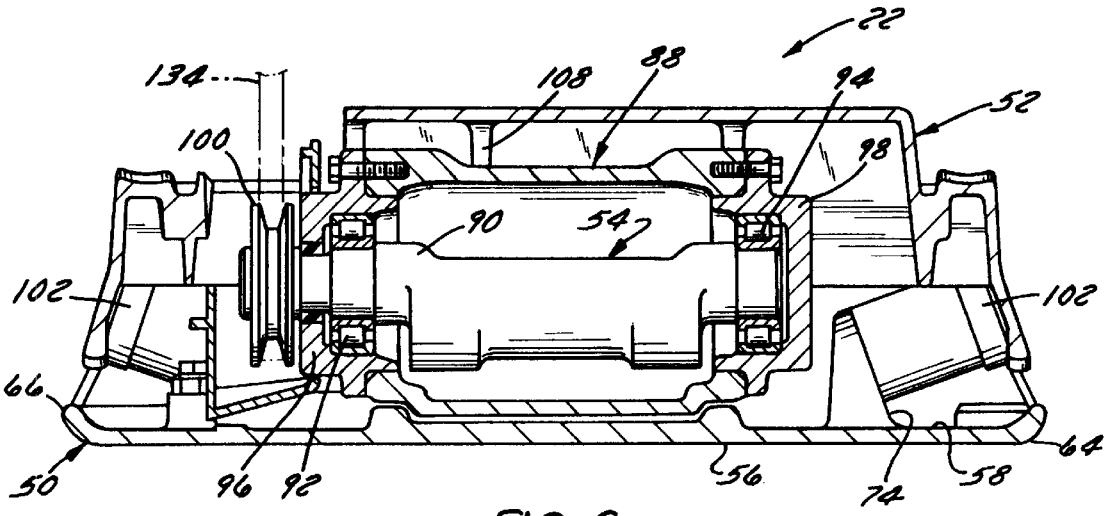
FIG. 6 is a sectional end elevation view taken through a center portion of an assembly of the vibratory plate machine that includes a console, a baseplate, and an exciter of the machine.
Figure 7:
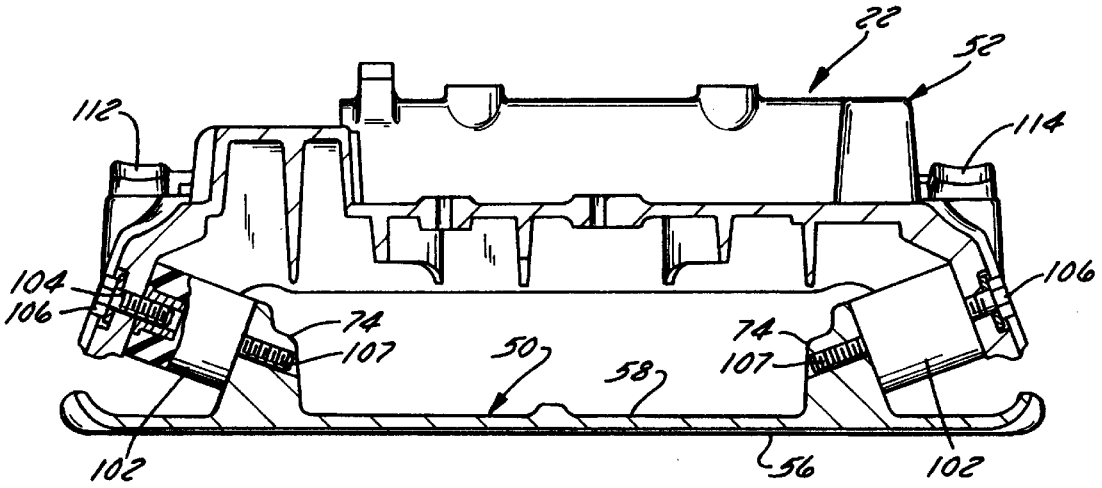
FIG. 7 is a sectional end elevation view of the assembly of FIG. 6, taken through a front end portion of the assembly.
Figure 8:
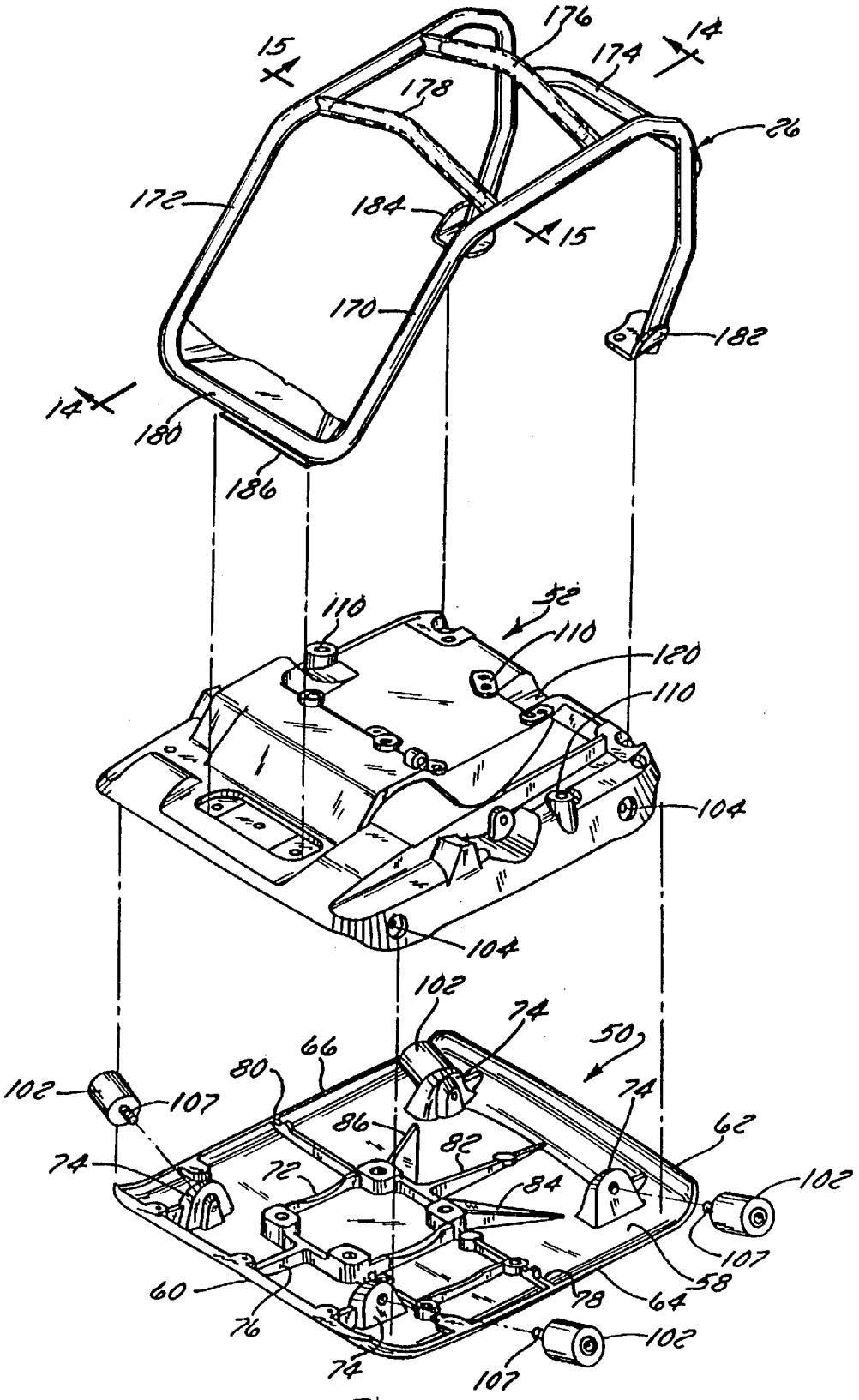
FIG. 8 is an exploded perspective view of a portion of the vibratory plate machine that includes the baseplate, the console, and a cage assembly of the machine.
Figure 9:
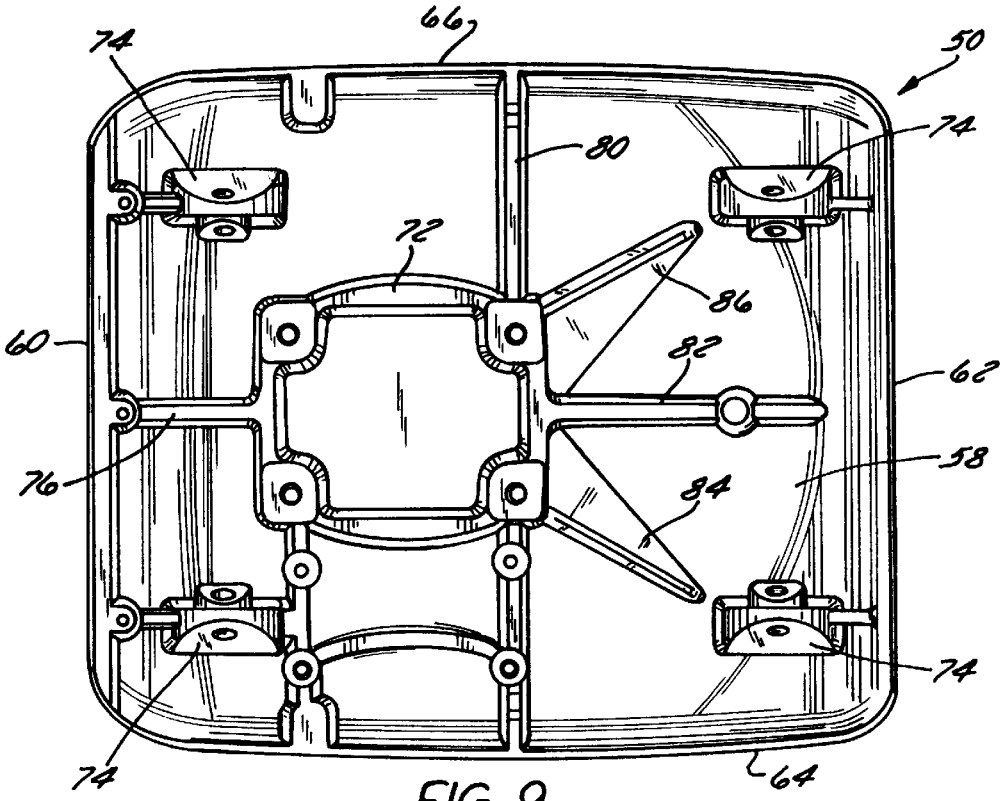
FIG. 9 is a top plan view of the baseplate.
Figure 10:
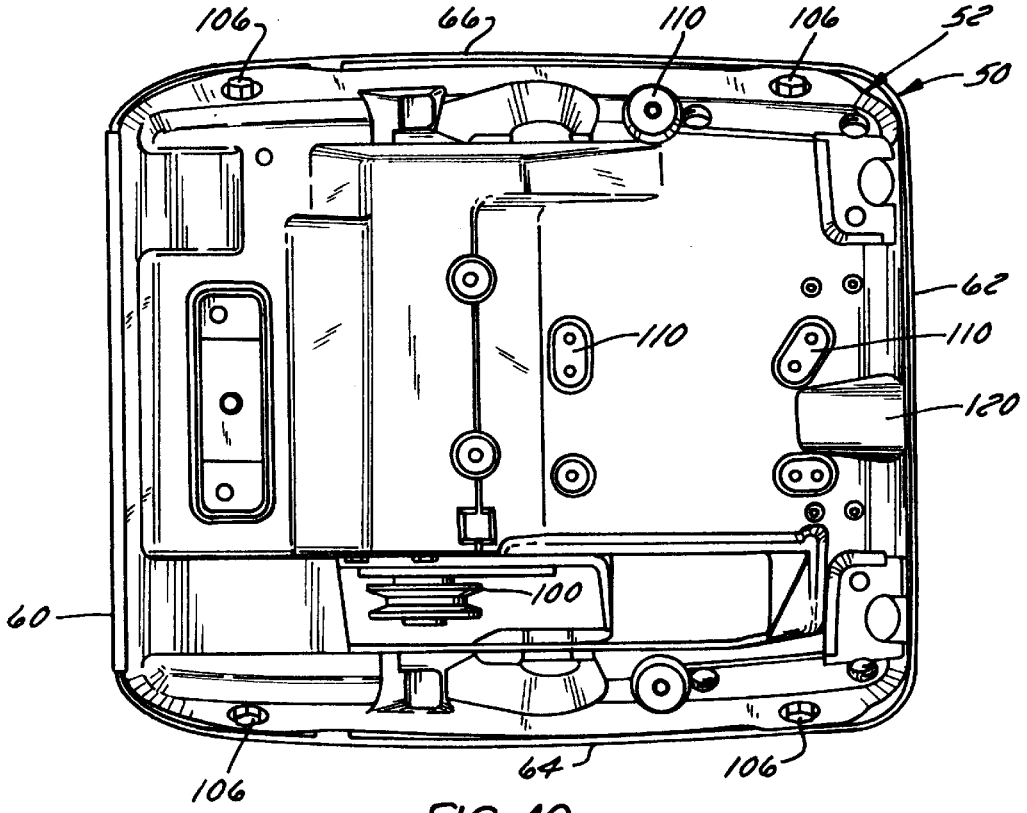
FIG. 10 is a top plan view of the console/baseplate/exciter assembly.
Figure 11:
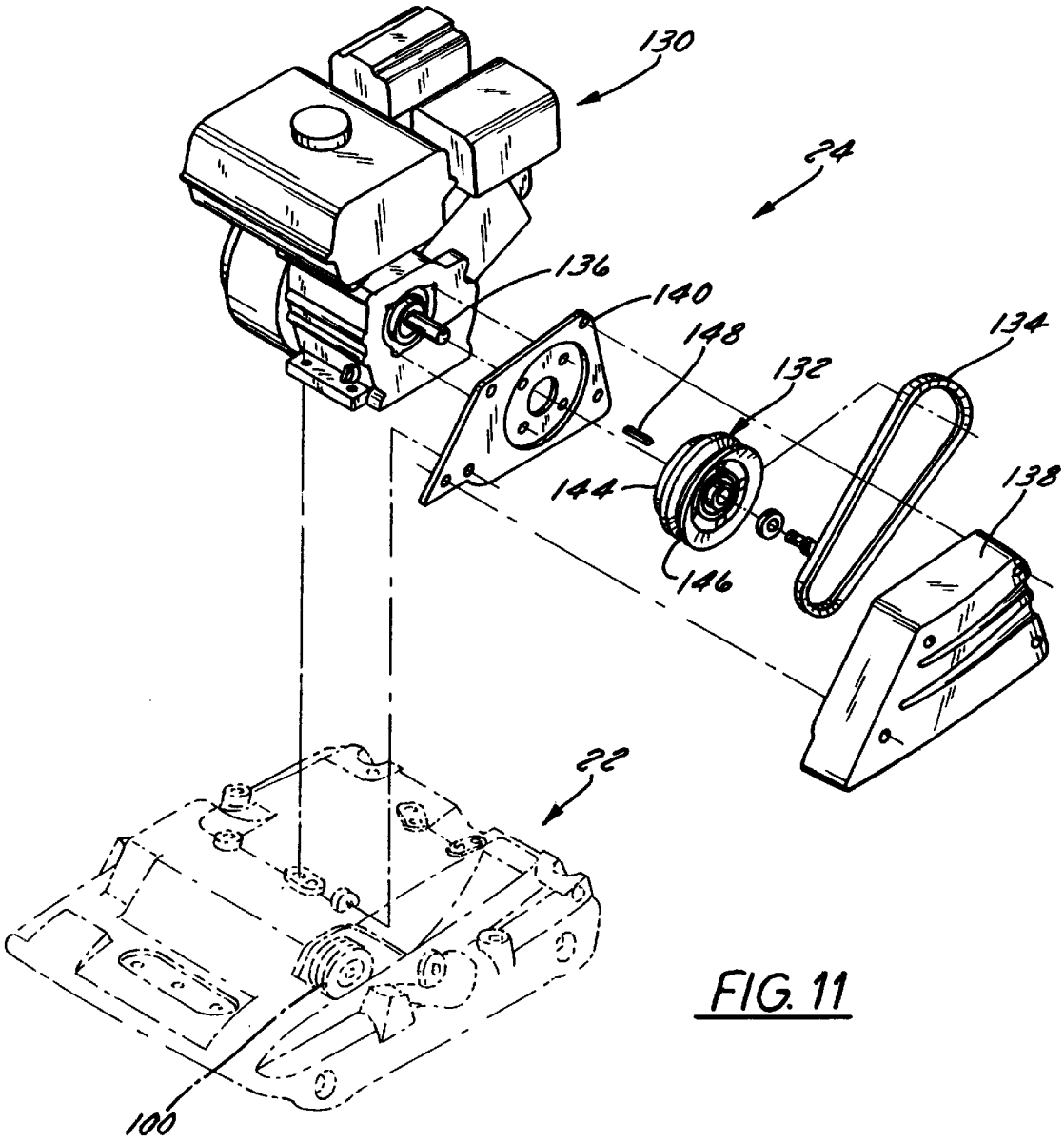
FIG. 11 is an exploded perspective view of a torque generation assembly of the vibratory plate machine of FIG. 1.
Figure 12:
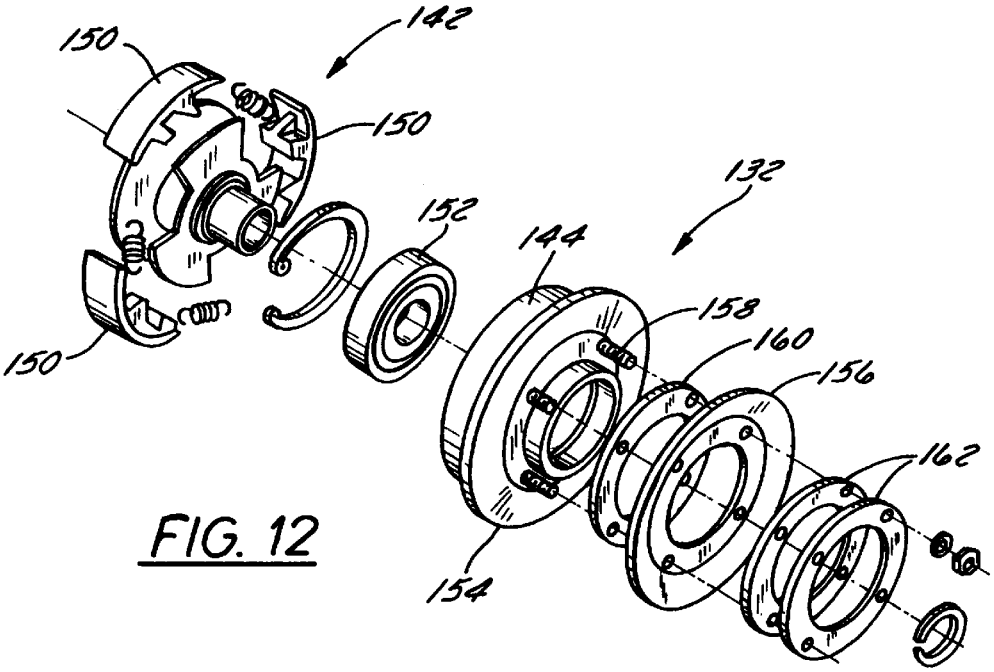
FIG. 12 is an exploded perspective view of a clutch of the torque generation assembly of FIG. 11.
Figure 13:
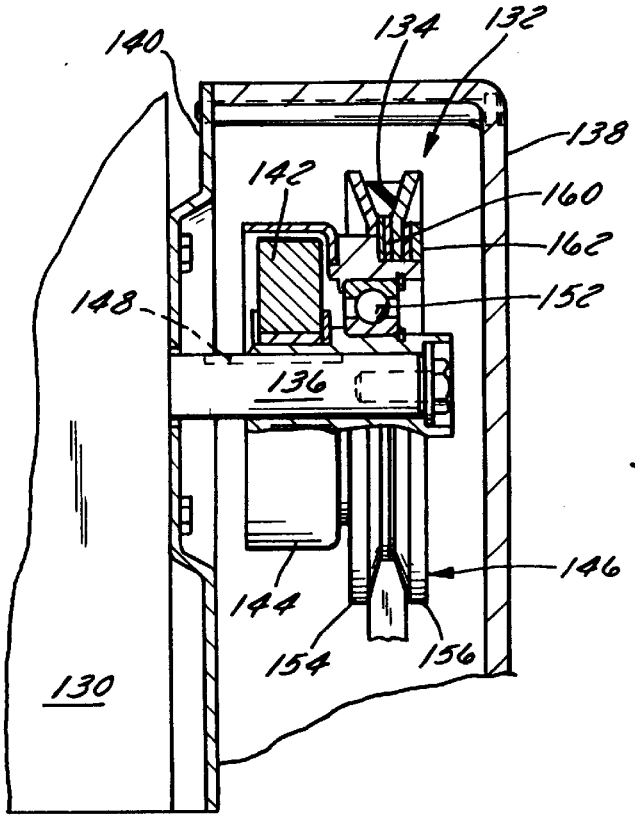
FIG. 13 is a partially cut-away, side elevation view of the clutch of FIG. 12 and of the surrounding portions of the torque generation assembly.

Referring now to the drawings and initially to FIGS. 1–5 in particular, a vibratory plate machine 20 is illustrated that is suitable for smoothing and/or compacting (henceforth referred to as "compacting" for the sake of simplicity) virtually any granular material such as sand, gravel, aggregate, etc. It is particularly well suited for compacting hot mix asphalt because it incorporates measures to prevent the asphalt from congealing on the machine. However, it is equally well suited for compacting other materials. The machine 20 can be conceptually separated into three distinct assemblies, namely: a console/baseplate/exciter assembly 22 (the individual components of which are best seen in FIGS. 6–8); a torque generation assembly 24 (the individual components of which are best seen in FIGS. 11–13); and a cage assembly 26 (the individual components of which are best seen in FIGS. 1–4, and 8. The machine 20 is designed for relatively small scale industrial operations in which an operator walks behind the machine 20 and guides and propels the machine using a handle assembly 28 connected to the console 52 of the console/baseplate/exciter assembly 22. Finally, because the machine 22 is designed for compacting asphalt, it includes a water supply system 30 for preventing asphalt from congealing on the machine 20.

The handle assembly 28 and water supply system 30 do not per se form part of the present invention apart from their interaction with the remaining inventive features of the machine 20. Hence, they will be described only briefly.

The handle assembly 28 is formed from a single U-shaped tubular metal member so as to form first and second relatively long side legs 32 and 34 and a center handle 36 connecting the upper end of the side legs 32 and 34 to one another. As best seen in FIGS. 1–4, the bottom of each of the side legs 32 and 34 is pivotally attached to the console 52 by a pivot assembly. Each pivot assembly includes a sleeve 38 welded to the bottom end of the side leg 32 or 34, one or more bushings (not shown) concentrically received in the sleeve 38, and a pivot pin 40 that extends through the bushing and is threaded into an intermediate sidewall of the console 52. The side legs 32 and 34 are bridged near their upper end by a metal plate 42 that serves as a mounting surface for instructions and other indicia and that helps damp vibrations that would otherwise be imposed on the operator's hands.

The water supply system 30 (FIGS. 1–4) is designed to spray water onto the asphalt surface being compacted directly in front of the machine 20 so that the asphalt does not congeal on a baseplate 50 of the console/baseplate/exciter assembly 22. The water supply system 30 includes 1) a storage tank 44 located on the console 52 of the console/baseplate/exciter assembly 22 directly in front of the torque generation assembly 24 and 2) a spray bar 46 mounted on the baseplate 50. The spray bar includes a plurality of spaced orifices (not shown) positioned so as to direct water onto the asphalt surface directly in front of the machine 20. Water may be transferred to the spray bar 46 from the tank 44 either directly by gravity or indirectly via an intervening pump that, may for example, be driven by the exciter. A pump-fed water supply system forms the subject of a separate application entitled "WATER SUPPLY SYSTEM FOR A VIBRATORY ASPHALT PLATE MACHINE," filed Jan. 28, 1997 and assigned Ser. No. 08/789,757 and the disclosure of which is hereby incorporated by reference in its entirety for the sake of completeness.

The manner in which the vibratory asphalt plate machine 20 is operated to compact materials will be described in detail following a discussion of the various inventive sub-assemblies of the machine.

3. Description of the Console/Baseplate/Exciter Assembly

Turning now to FIGS. 1–10, the console/baseplate/exciter assembly 22 includes a baseplate 50, a console 52 mounted on the baseplate 50, and an exciter 54 mounted on the baseplate 50 beneath the console 52. These components interact with one another and with the remaining components of the machine 20 to improve the stability and maneuverability of the machine 20 while 1) reducing the imposition of vibrations on the console 52 by the exciter 54 and baseplate 50, 2) increasing the durability of the machine 20, 3) reducing the weight of the machine 20, and 4) inhibiting the accumulation of debris between the console 52 and the baseplate 50.

The baseplate 50 is formed from a single nodular ductile iron plate having 1) a bottom or compacting surface 56 and 2) an upper surface 58 on which are mounted a plurality of reinforcing ribs, an exciter mount, and other mounting bosses. Front, rear, left side, and right side edges or surfaces 60, 62, 64, and 66 of the baseplate 50 all bend or curl upwardly to 1) increase strength, 2) enhance maneuverability and stability, and 3) to reduce ridging or other marring of the surface being compacted. Novel aspects of the baseplate 50 reside in the topography of the bottom surface 56, the bottom plan profile, and the ribs on the upper surface 58. Each of these features will now be detailed.

The topography of the bottom or compacting surface 56 of the baseplate 50 is designed to enhance stability and maneuverability and to reduce ridging and other marring effects during operation of the machine 20. Most notably, and as best seen in FIG. 5, the surface comprises a curved, preferably semi-spherical, convex portion 68 curving downwardly and inwardly from the edges 60, 62, 64, and 66 of the baseplate 50 towards a flat or planar portion 70, with the convex portion 68 surrounding the flat portion 70. The flat portion 70 is located underneath the exciter 54 and preferably is centered beneath the exciter 54 both longitudinally and laterally, as shown in FIG. 5. The curvature of the semi-spherical portion 68 is very gentle, preferably being above 200" and even more preferably about 550". The flat portion 70 is semi-circular in shape, encompassing an arc of about 270° (it would encompass an arc of a full 360° but for the upwardly-curled front edge surface 60 of the baseplate 50). In the illustrated embodiment in which the dimensions of the bottom surface 56 are approximately 17" square (excluding the beginning of curvature on the sides, front and rear edge surfaces), the flat region 70 has a diameter of approximately 15". The front edge surface 60 is curled upwardly and forwardly from the bottom surface at a radius of approximately 5", and the rear edge surface 62 is curled upwardly and rearwardly from the bottom surface at a radius of approximately 2.5". The side edge surfaces 64 and 66 are barrel-shaped when seen in bottom plan view to facilitate maneuvering around corners and other obstructions and to enhance stability. That is, they curl upwardly and outwardly and also curve laterally inwardly so that the bottom surface 56 of the baseplate 50 is substantially wider at the center than at either of its longitudinal ends.

Turning now to FIGS. 6–9, the upper surface 58 of the baseplate 50 receives an exciter mount frame 72, four shockmount bosses 74, and a plurality of stiffening ribs 76, 78, 80, 82, 84, and 86. The exciter mount frame 72 and shockmount bosses 74 are conventional save for the fact that the shockmount bosses 74 are disposed laterally outwardly of conventional shockmount boss mounting positions as discussed in more detail below in connection with the console 52. The ribs are dimensioned and configured to provide maximum stiffening with a minimum necessary increase in weight. The ribs also are configured to channel debris that accumulates on the upper surface 58 of the baseplate 50 off from the baseplate. The ribs include a first rib 76 extending forwardly from the forward edge of the exciter mount frame 72. Second and third ribs 78 and 80 are arranged generally co-linear with one another and are located in longitudinal central region of the baseplate 50 so as to extend laterally outwardly from the rear portion of the exciter mount frame 72 towards the side edge surfaces 64 and 66 of the baseplate 50. Third, fourth, and fifth ribs 82, 84, and 86 all extend longitudinally rearwardly from the rear wall of the exciter mount frame 72 and are configured individually and with respect to one another to channel debris off from the baseplate 50. Towards these ends, they are each generally triangular in longitudinal profile so that they are higher at their forward ends than at their rear ends. They are also generally triangular in lateral profile so that they are thinner at their tops than at their bottoms. The fourth rib 82 extends longitudinally from the center of the rear wall of the exciter mount frame 72. The fifth and sixth ribs 84 and 86 extend at an acute angle from respective corners of the exciter mount frame 72 towards respective rear corners of the baseplate 50. In use, the rear-wall of the exciter mount frame 72 and the second and third ribs 78 and 80, in combination, act as a dam that prevents material that accumulates on the baseplate 50 from moving forwardly of their position. The fourth, fifth, and sixth ribs 82, 84, and 86 channel that material off from the baseplate 50 as the baseplate 50 vibrates under action of the exciter 54.

The exciter 54 is per se conventional and hence will be discussed only briefly. Referring particularly to FIG. 6, the exciter 54 includes a housing 88 which is mounted on the exciter mount frame 72 and in which is disposed an eccentric metal shaft 90. The shaft 90 is rotatably supported in bearings 92, 94 that are in turn supported in end caps 96, 98 of the housing 88. One end of the shaft 90 extends through its corresponding end cap 96 to receive a driven pulley 100. Rotation of the pulley 100 under action of a belt 134 as detailed below causes the shaft 90 to rotate, thereby imparting vibrations to the baseplate 50 in a manner which is per se well known.

Turning now to FIGS. 6–8, the console 52 is mounted on the baseplate 50 by cylindrical elastomeric shockmounts 102. Specifically, a bolt 106 extends through a hole 104 in each corner of the console 52 and is threaded into the upper axial end of an associated shockmount 102. A stud 107 extends inwardly and downwardly from the bottom axial end of each shockmount 102 and is threaded into one of the shockmount bosses 74 on the baseplate 50.

The console 52 is novel primarily in that it is cast from a single piece of metal, preferably aluminum, rather than being welded from many (typically 25 or more in the past) pieces of steel plate. As seen in FIGS. 6–10, a plurality of reinforcing ribs 108 extend downwardly from the bottom surface of the console 52 for stiffening purposes. A plurality of threaded holes 110 are tapped into flats on the upper surface for receiving mounting screws for the engine 130, cage assembly 26, etc. Lift handles 112 and 114 are fixed to opposed sides of the rear end of the upper surface of the console 52 for facilitating lifting as detailed below. Front and rear stops 116 and 118 are also casted on each side of the console 52 to provide rest points for the side legs 32 and 34 of the handle assembly 28. The legs 32 and 34 will normally rest on the rear stops 118 when the machine 20 is not in use and will pivot upwardly some amount when the machine 20 is being operated. However, in some instances in which it is desirable to push the machine 20 under low lying obstructions, the handle assembly 28 can be pivoted forwardly as far as the front stops 116 at which time its maximum height will be lower than the height of the rest of the machine 20 so that the machine 20 can be pushed or pulled under the obstruction.

Several benefits result from forming the console 52 from a cast metal rather than weldments. First, because there are no welds or braces at the corners of the console 52, the holes 104 for receiving the shockmounts 102 can be located at the extreme corner portions of the console 52 so that the shockmounts 102 are located further towards the corners of the baseplate/exciter/console assembly 22. Second, an oil drain trough 120 can be cast into the rear portion of the upper surface of the console 52 so as to have a first end located beneath an oil drain port 122 of the engine 130 (FIG. 3) and a second end terminating at the rear edge surface of the console 52. Because the floor of the trough 120 is recessed with respect to the remainder of the console upper surface, oil that is drained from the engine 130 and into the trough 120 runs directly off from the console 52 rather that spreading in a pool. Third, the total labor required to assemble the machine is decreased by about 25% due to the use of the cast one piece console as opposed to the prior art welded console. Fourth, the cast aluminum console 52 is much lighter weight than comparable welded steel consoles.

4. Construction of Torque Generation Assembly

Referring now to FIGS. 1–4 and 11–13, the torque generation assembly 24 includes an engine 130, a clutch 132, and a torque transmitting member in the form of a V-belt 134 coupling the clutch 132 to the driven pulley 100 of the exciter 54. The engine 130 is a conventional, relatively small (on the order of six horsepower) gasoline powered engine bolted on the upper surface of the console 52 and having a horizontal output shaft 136 as best seen in FIGS. 11 and 13.

The V-belt 134 extends from the drive pulley 146 of the clutch 132 to the driven pulley 100 of the exciter 54 to transfer torque to the exciter 54. A belt guard 138 surrounds the clutch 132 and is connected to a mounting plate 140 disposed in front of the clutch 132. The mounting plate 140 is bolted to the engine 130 and to the console 52 as best seen in FIGS. 11 and 13.

The clutch 132 is of the high inertia, negative engaging type in which engagement occurs automatically upon engine output shaft acceleration with minimal jerking motion. The clutch 132 is specially designed to increase belt life by acting as a flywheel that damps jerking motions that would otherwise be imparted to the belt 134 by relative movement between the console 52 (on which the engine 130 and clutch 132 are mounted) and the baseplate 50 (on which the exciter 54 is mounted). Towards this end, the clutch 132 is designed to be heavier than standard clutches typically used in applications such as the present invention and to distribute this weight towards the outer diameter of the clutch. The clutch 132 includes a shoe assembly 142, a drum 144, and a drive pulley 146.

The shoe assembly 142 is fixed to the engine output shaft 136 by a key 148. Shoe assembly 142 presents three spring-biased shoes 150 which expand outwardly to engage the drum 144 when centrifugal forces imposed by the rotating output shaft 136 are sufficiently high for clutch engagement.

The drum 144 is rotatably mounted on the shaft 136 by a bearing 152 and is disposed around the shoes 150 so as to be engaged by the shoes 150 upon clutch engagement. The drum 144 is fixedly coupled to a drive pulley 146 such that the pulley 146 rotates upon rotation of the drum 144. In the past, the drum and drive pulley were made from relatively lightweight stamped metal components. In the present invention, the drum 144 and an inner section 154 of the drive pulley 146 are formed integrally from a piece of relatively heavy cast metal. The drum 144 is also significantly larger in diameter than in a standard drum/pulley arrangement (having a diameter of about 4¾" compared to the standard 3¾" drum.) An outer section 156 of the drive pulley 146 is attached to the inner section 154 by studs 158. The outer section 156 could be formed either from stamped metal or a separate piece of cast metal.

The effective width of the pulley 146 can be adjusted to accommodate different belt lengths by adding one or more shims 160 as required between the two pulley sections 154 and 156. Additional spacers 162 are provided at the outer end of the clutch 132 as desired for optimal pulley placement.

5. Construction of Cage Assembly

The cage assembly 26 is designed to effectively encase the engine 130 and water tank 44 so as to protect them from damage should the machine 20 be tipped over or otherwise be subjected to external shocks. The cage assembly 26 is also designed to facilitate lifting of the machine 20 for site-to-site transport. Towards these ends, the cage assembly 26 is formed from a plurality of interconnected metal tubes which encase the engine 130 and the water tank 44.

Figure 1:
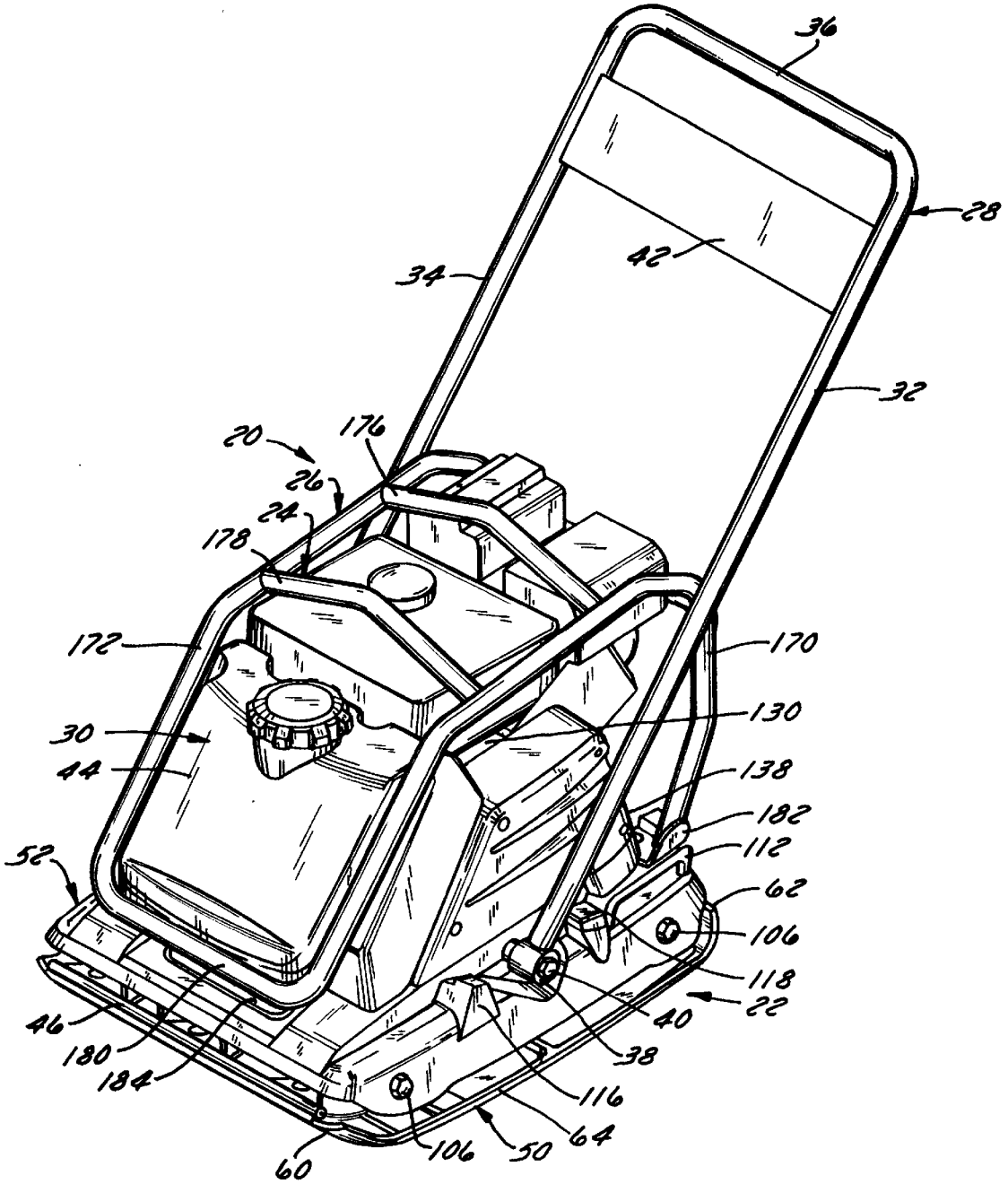
FIG. 1 is a perspective view of a vibratory plate machine constructed in accordance with a preferred embodiment of the invention.
Figure 2:
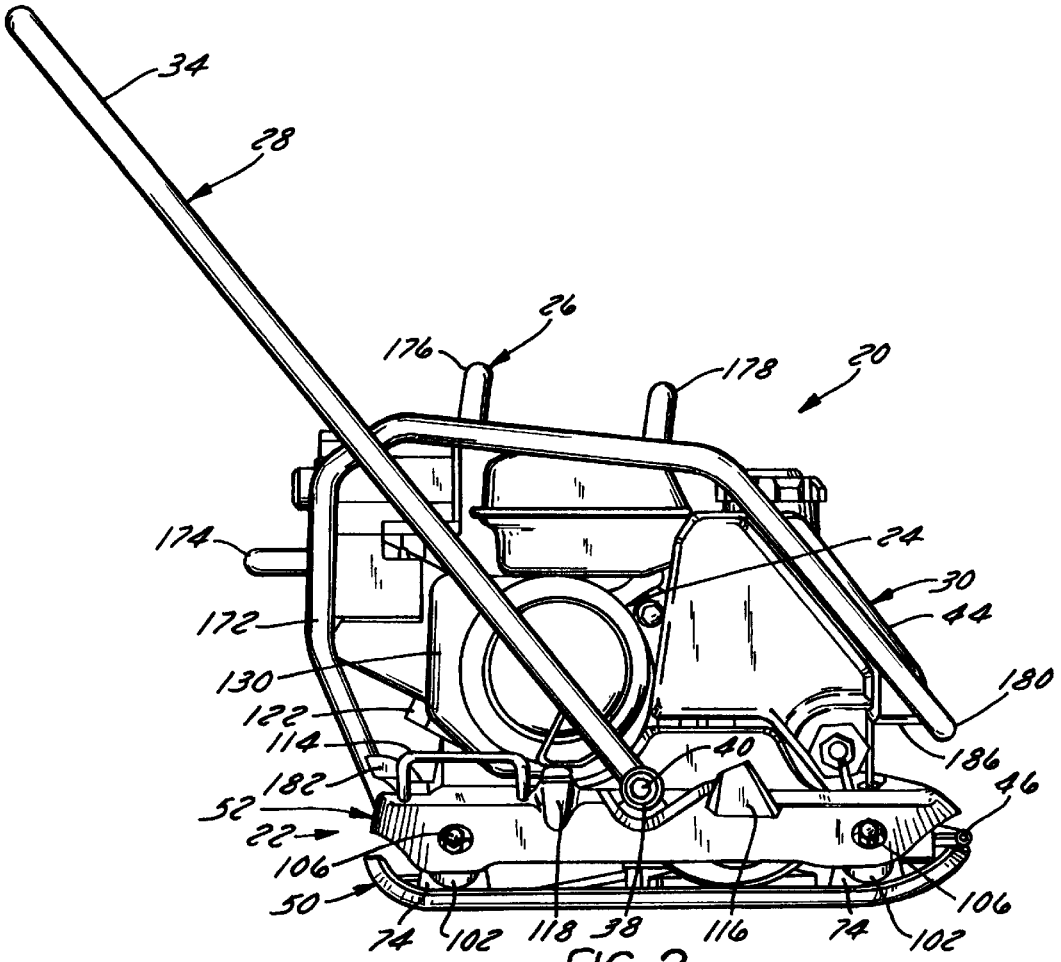
FIG. 2 is a right side elevation view of the vibratory plate machine of FIG. 1.
Figure 4:
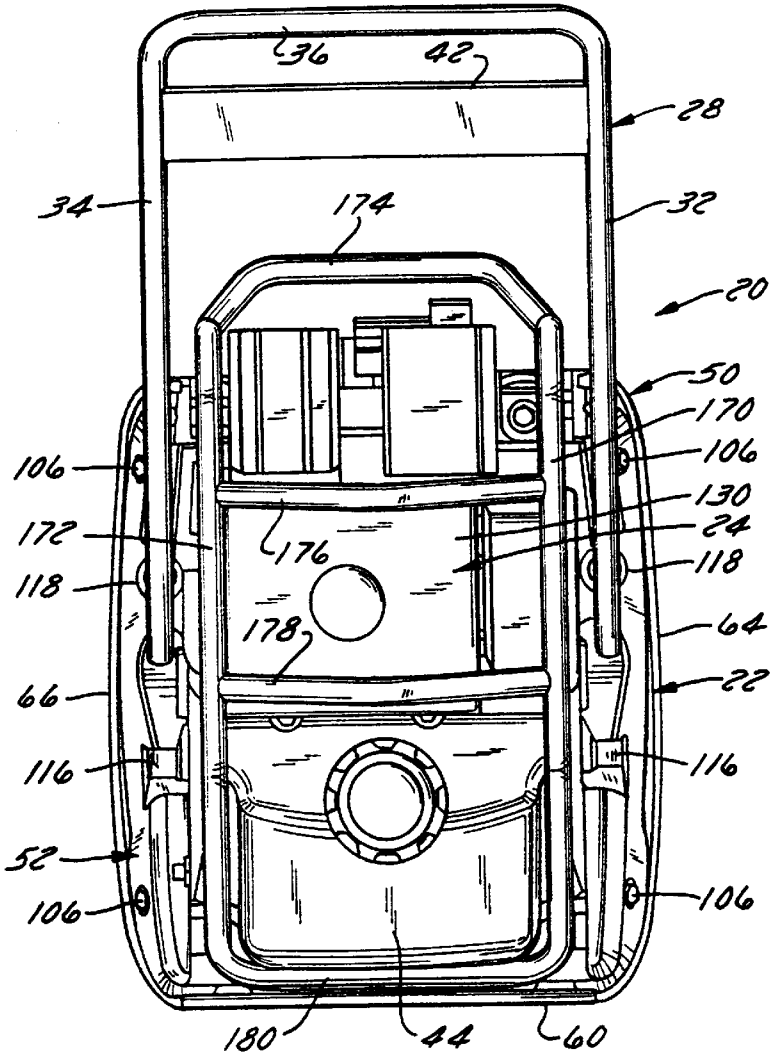
FIG. 4 is a top plan view of the vibratory plate machine of FIG. 1.
Figure 3:
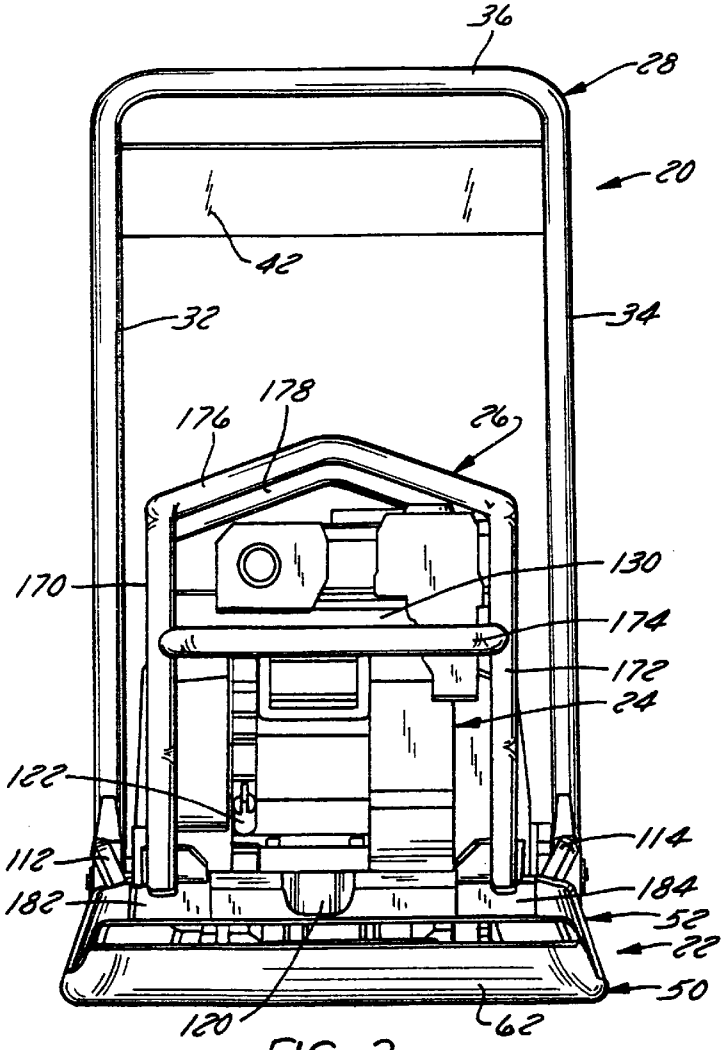
FIG. 3 is a rear elevation view of the vibratory plate machine of FIG. 1.

The cage assembly 26 includes first and second side braces 170 and 172 connected to one another by a plurality of cross bars 174, 176, 178, and 180. The side braces 170 and 172 are bent into a generally n-shaped profile so as to encase both the engine 130 and the water tank 44 as best seen in FIGS. 1–4 and 8. The cross bars include a rear cross bar 174 positioned adjacent the upper end of the engine 130 as best seen in FIG. 3, first and second upper cross bars 176 and 178 extending across and over the engine 130 as best seen in FIGS. 1 and 4, and a front cross bar 180 located adjacent the bottom end of the water tank 44 as best seen in FIG. 1. The cage assembly 26 is mounted on the console 52 by rear brackets 182 and 184 attached to the bottom ends of the side braces 170 and 172 and by a front bracket 186 attached to the central portion of the front cross bar 180.

The upper cross bars 176 and 178 are configured and located to facilitate lifting of the machine 20 while simultaneously providing maximum protection and an aesthetically attractive appearance. Towards these ends, both cross bars 176 and 178 have a shallow inverted V-shape when viewed in side elevation. The upper front cross bar 178 is located near the center of mass of the machine 20 so as to enable it to serve as a sole lift point for transporting the machine 20 from site to site. The lower front bar 180 and lift handles 112 and 114 can be used in conjunction with one another as an alternative lift arrangement.

6. Operation of Vibratory Plate Machine

The vibratory plate machine 20 is operated by starting the engine 130 and supplying sufficient throttle to effect clutch engagement, at which point torque is transferred from the clutch 132 to the exciter 54 by way of the V-belt 134. Rotation of the eccentric rotating shaft 90 of the exciter 54 imparts vibrations to the baseplate 50 to compact material. The operator then guides and moves the machine 20 along an intended compaction path using the handle assembly 28. In the illustrated embodiment in which the machine 20 is designed to compact asphalt, the water supply system 30 sprays water onto the asphalt surface directly in front of the machine 20 to prevent asphalt from congealing on the baseplate 50.

Stability and maneuverability of the machine 20 are enhanced by the semi-spherical, convex portion 68 on the bottom surface 56 of the baseplate 50, and this portion also reduces the possibility that the surface being compacted will be ridged or otherwise marred by operation of the machine 20. The barrel-shaped side edge surfaces 64 and 66 of the baseplate 50 also facilitate maneuvering of the machine 20 around obstructions. Any debris that accumulates on the upper surface 58 of the baseplate 50 during machine operation is channeled off from the baseplate 50 by the ribs 78, 80, 82, 84, and 86.

The relationship between the baseplate 50 and the remainder of the machine 20 limits detrimental effects on the rest of the machine 20 in several ways.

First, because the shockmounts 102 are located at the extreme corners of the machine 20, the vibration damping effectiveness and stability enhancement effectiveness of the shockmounts 102 are maximized, resulting in transmission of minimal vibrations to the console 52 and the operator.

Second, because the relatively large and heavy high inertia clutch 132 acts as a flywheel, jerking movements that otherwise may be imposed on the belt 134 are minimized, thereby dramatically increasing belt life. Indeed, preliminary tests indicate that average belt life is increased by at least 50% through the use of the inventive high inertia clutch 132 from an average of about 100 hours to 150–170 hours.

Finally, the cage assembly 28 also facilitates machine lifting and protects the engine 130 and water tank 44 from external shocks.

Many changes and modifications may be made within the scope of the present invention without departing from the spirit thereof. The scope of these changes will become apparent from the attached claims.

I claim:

1. A vibratory plate machine comprising:

(A) a baseplate having a lower surface which compacts materials on a surface, an upper surface, opposed side surfaces connecting said upper and lower surfaces to one another, and opposed front and rear surfaces connecting said upper and lower surfaces to one another, said front and rear surfaces being curved laterally outwardly and upwardly from said lower surface; and (B) an exciter which is located above said baseplate and which imparts a vibratory motion to said baseplate, wherein said lower surface of said baseplate has a convex portion which surrounds another substantial portion of said lower surface, which rests on the surface to be compacted, and which extends from said another substantial portion to said front and rear surfaces.

2. A vibratory plate machine as defined in claim 1, wherein said side surfaces of said baseplate are barrel-shaped so that 1) said side surfaces curve laterally outwardly and upwardly from said lower surface and 2) said lower surface is wider at a central portion thereof than at opposed longitudinal ends thereof.

3. A vibratory plate machine defined in claim 1, wherein a plurality of reinforcing ribs are provided on said upper surface of said baseplate, said ribs being dimensioned and configured to channel debris that accumulates on said upper surface off from said baseplate.

4. A vibratory plate machine as defined in claim 3, wherein at least some of said ribs are generally triangular when viewed in longitudinal cross-section.

5. A vibratory plate machine as defined in claim 1, further comprising a console which is mounted on said upper surface of said baseplate and which encases said exciter, said console being formed from a unitary cast metal element; and a plurality of elastomeric shockmounts via which said console is mounted on said baseplate, each of said shockmounts being attached to said console at a location closely adjacent a corner of said console.

6. A vibratory plate machine as defined in claim 1, further comprising a console mounted on said baseplate;

an engine mounted on said console and operable to transmit drive torque to said exciter; and a cage assembly which is mounted on said console and which extends over said engine, said cage assembly including first and second opposed side braces each of which is bent into a generally n-shaped profile, a rear lower cross bar which is located behind said engine and which connects said first and second side braces to one another, and front and rear upper cross bars each of which is located above said engine and each of which connects said first and second side braces to one another.

7. A vibratory plate machine comprising:

(A) a baseplate having a lower surface which compacts materials on a surface, an upper surface, and opposed side surfaces connecting said upper and lower surfaces to one another; and (B) an exciter which is located above said baseplate and which imparts a vibratory motion to said baseplate, wherein said lower surface of said baseplate has a convex portion which surrounds a substantial portion of said lower surface and which rests on the surface to be compacted, and wherein said substantial portion of said lower surface is a planar portion and is centered under said exciter.

8. A vibratory plate machine comprising:

(A) a baseplate having a lower surface which compacts materials on a surface, an upper surface, and opposed side surfaces connecting said upper and lower surfaces to one another; and (B) an exciter which is located above said baseplate and which imparts a vibratory motion to said baseplate, wherein said lower surface of said baseplate has a convex portion which surrounds a substantial portion of said lower surface and which rests on the surface to be compacted, wherein a plurality of reinforcing ribs are provided on said upper surface of said baseplate, said ribs being dimensioned and configured to channel debris that accumulates on said upper surface off from said baseplate, wherein said ribs include 1) a first rib extending laterally across a substantial length of a longitudinally central portion of said baseplate, 2) a second rib extending longitudinally rearwardly from a laterally and longitudinally central portion of said baseplate, and 3) third and fourth ribs located laterally between said second rib and said first and second side surfaces of said baseplate, respectively, each of said third and fourth ribs having a front end located on said longitudinally central portion of said baseplate and a rear end located laterally beyond said front end.

9. A vibratory plate machine as defined in claim 8, wherein said convex portion has a constant curvature so as to be partially-spherical in shape.

10. A vibratory plate machine as defined in claim 9, wherein said planar portion is semi-circular in shape.

11. A vibratory plate machine as defined in claim 8, wherein said planar portion is centered under said exciter both laterally and longitudinally.

12. A vibratory plate machine as defined in claim 8, wherein said planar portion is disposed forward of the center of said baseplate and adjacent said convex portion.

13. A vibratory plate machine as defined in claim 1, further comprising an engine which has an output shaft, a clutch receiving torque from said output shaft, and a belt that transfers torque from said clutch to said exciter, wherein said clutch comprises 1) a first pulley section and 2) a second pulley section and a drum integrated into a single cast metal pulley/drum assembly, said pulley/drum assembly being connected to said first pulley section.

14. A vibratory asphalt plate machine comprising:

(A) a baseplate having a lower surface which smoothes asphalt, an upper surface, and opposed side surfaces connecting said upper and lower surfaces to one another; and (B) an exciter which is located above said baseplate and which imparts a vibratory motion to said baseplate, wherein said lower surface of said baseplate is generally convex and has a semi-spherical portion that at least partially surrounds a planar portion, said planar portion being centered underneath said exciter and being semi-circular in shape, said semi-spherical portion having a radius of greater than 200", and wherein said side surfaces of said baseplate are barrel-shaped so that 1) said side surfaces curve laterally outwardly and upwardly from said lower surface and 2) said lower surface is wider at a central portion thereof than at opposed longitudinal ends thereof.

* * * * *

UNITED STATES PATENT AND TRADEMARK OFFICE

CERTIFICATE OF CORRECTION

PATENT NO. : 5,934,825
DATED : August 10, 1999
INVENTOR(S) : Waldenberger

It is certified that error appears in the above-identified patent and that said Letters Patent is hereby corrected as shown below:

Column 12, line 30, delete "claim 8" and insert --claim 7--.
Column 12, line 33, delete "claim 8" and insert --claim 7--.

Signed and Sealed this

Twenty-fifth Day of April, 2000

*Attest:*

Q. TODD DICKINSON

*Attesting Officer*

*Director of Patents and Trademarks*